United States Patent [19]

Holcomb

[11] Patent Number: 4,960,024

[45] Date of Patent: Oct. 2, 1990

[54] CHEESE DISPENSER

[75] Inventor: David A. Holcomb, Seattle, Wash.

[73] Assignee: Chef'N Corporation, Seattle, Wash.

[21] Appl. No.: 332,169

[22] Filed: Mar. 30, 1989

[51] Int. Cl.[5] ..... B67D 5/42; B67D 5/22; B26D 7/00

[52] U.S. Cl. ..... 83/423; 83/648; 83/651.1; 222/39; 222/80; 222/386; 222/620

[58] Field of Search ..... 222/39, 386, 390, 391, 222/613, 620, 80; 221/248, 249, 268, 275, 279, 306, 272; 220/350; 206/816; 401/12, 175; 83/417, 648, 651.1

[56] References Cited

U.S. PATENT DOCUMENTS

| | | | |
|---|---|---|---|
| 145,439 | 12/1873 | Miller . | |
| 1,125,734 | 1/1915 | Savoye et al. | 221/249 |
| 1,581,074 | 10/1924 | MacFarland . | |
| 2,270,935 | 1/1942 | Doering | 222/386 |
| 2,575,967 | 11/1951 | May | 222/39 |
| 2,702,942 | 3/1955 | Michaelis | 222/390 |
| 2,751,118 | 6/1956 | Soule | 222/390 |
| 2,972,407 | 2/1961 | Taylor | 222/386 |
| 4,245,756 | 1/1981 | Byrne et al. | 221/275 |
| 4,505,410 | 3/1985 | Coulter | 222/390 |
| 4,544,083 | 10/1985 | Schroeder | 222/390 |
| 4,793,521 | 12/1988 | Steiner | 222/390 |
| 4,811,842 | 3/1989 | Sekiya | 221/248 |

FOREIGN PATENT DOCUMENTS

| | | |
|---|---|---|
| 056936 | 8/1982 | European Pat. Off. . |
| 399461 | 5/1933 | United Kingdom . |
| 595666 | 12/1947 | United Kingdom . |
| 612337 | 11/1948 | United Kingdom . |
| 1384747 | 2/1975 | United Kingdom . |
| 1489439 | 10/1977 | United Kingdom . |

*Primary Examiner*—H. Grant Skaggs
*Assistant Examiner*—Steven Reim
*Attorney, Agent, or Firm*—Seed and Berry

[57] ABSTRACT

A cheese dispenser is provided with a compartment having closed ends, top, bottom, and sidewalls and open front end. An enlarged disc drives a flexible cover which can, by rotation of the disc, cause the cover to hermetically seal the open front end of the dispenser of the compartment or open the front end of the compartment. The disc also operates through a gear reduction unit to drive a pusher simultaneously with the opening of the flexible cover or door. Thus by rotating the disc, the door is open simultaneously with advancement of the cheese out of the open end. A slicer mechanism is provided on the open end to slice desired thicknesses of the cheese.

11 Claims, 4 Drawing Sheets

CHEESE DISPENSER

Background of the Invention

This invention pertains to devices for storing and dispensing slices of cheese or other solid foods to be sliced.

Description of Prior Art

Various types of dispensers for handling solid foods such as block cheese or large pieces of cheese are known. U.S. Pat. No. 2,270,935 shows a food carton having a pusher to move a block of cheese out of the end of the carton. A knife or a slicer mechanism then slices the advancing block of cheese into slices.

U.S. Pat. Nos. 145,439 and 1,581,074 show devices for dispensing fluid substances out of a container.

Summary of the Invention

This invention is directed to a dispenser which can advance a block of the food smoothly and easily out of the end of a storage compartment. While any suitable solid food such as cheese, butter, pate, salami, etc. can be used with the invention, the invention will be described hereinafter with reference to cheese, for brevity. The dispenser includes a drive mechanism which can simultaneously open a flexible door which hermetically seals the inside of the compartment and moves a pusher such that the door is opened automatically in advance of the cheese being pushed out of the compartment.

Another unique feature of the invention is that the drive mechanism for powering the pusher and powering the flexible door is an enlarged disc with a gear reduction unit so that low force is needed to rotate the disc and yet advance the cheese over the inside surface of the compartment. In one embodiment, the disc extends below the bottom of the compartment and is provided with a frictional peripheral surface. By pressing the compartment down and forwardly, the disc is driven by the frictional engagement with the surface upon which the compartment is resting to provide additional torque and one-hand operation of the cheese dispenser.

As will be apparent to one skilled in the art, the dispenser when provided with all the foregoing features uniquely includes a hermetically sealable compartment and a drive mechanism that can simultaneously open the cover to expose the open end of the compartment and advance the cheese all with a single one-hand operation.

A slicing mechanism is provided to reciprocate along the open end of the compartment for slicing the advanced cheese into desired thickness slices. In one embodiment, the drive mechanism is provided with a clicker so that a signal and feel is given when the cheese block has been advanced a desired cheese slice thickness.

The dispenser advantageously allows the block of cheese to be stored in a relatively airtight condition. This reduces the possibility of mold forming on the cheese. The cheese then can be advanced and sliced very easily and efficiently with one hand advancing the disk or advancing the compartment and with the other hand operating the slicing mechanism.

Detailed Description of the Preferred Embodiments

Figure 4:
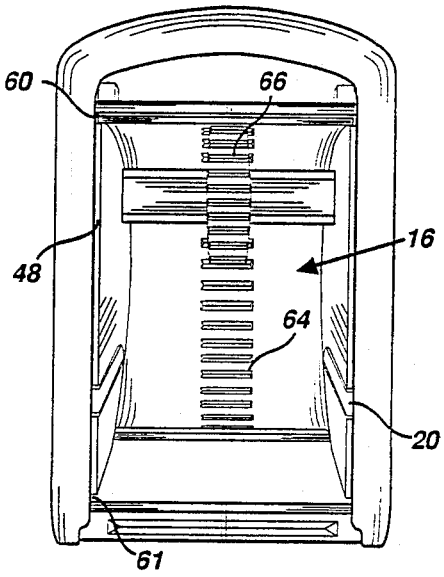
FIG. 4 is an end elevation looking into the open end of the compartment.
Figure 5:
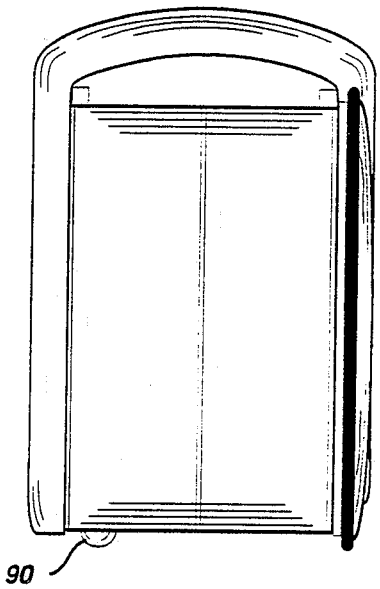
FIG. 5 is an end elevation looking in at the rear end of the compartment.
Figure 6:
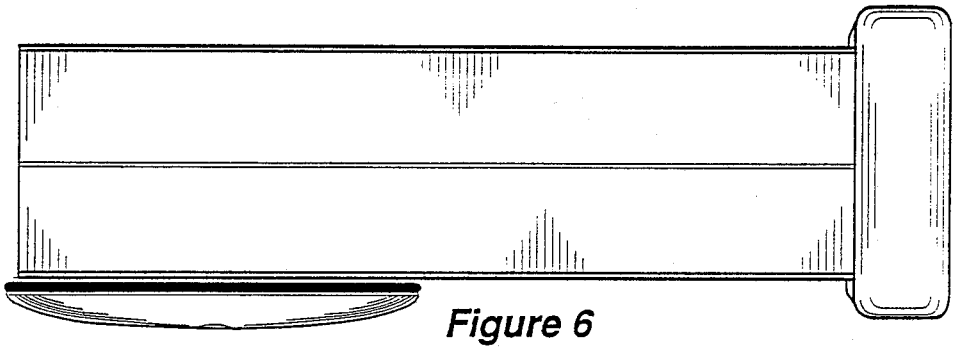
FIG. 6 is a top view of the dispenser.
Figure 7:
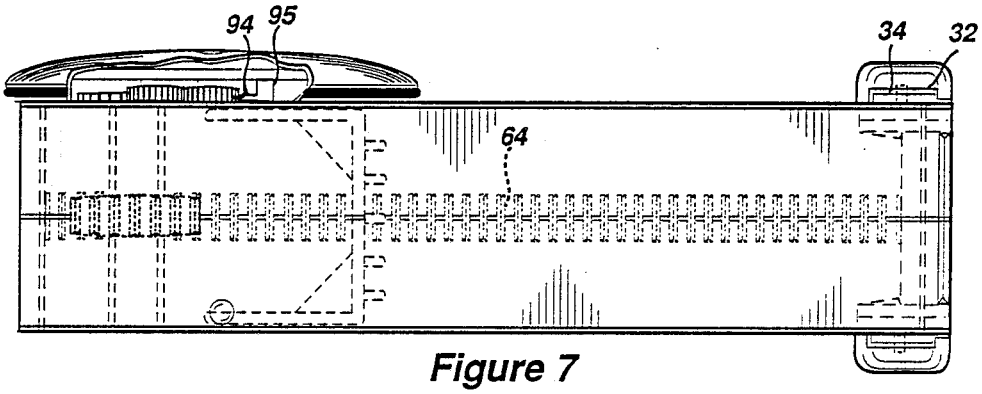
FIG. 7 is a bottom view of the dispenser.

The dispenser includes a compartment 12 having a right side wall 13 and a left side wall 14, a closed end 15 and an opened end 16 (FIG. 4). The compartment also has a closed bottom 17 and a closed top 18. Preferably, the compartment is molded into an integral compartment.

The side walls have on their insides a pair of opposed grooves 20 running along the length of the side walls. A pusher mechanism 22 is provided with flanges 24 on opposite sides which ride in the grooves 20. The pusher can move along the grooves fore and aft being supported by the grooves. The flanges 24 are of a substantial length to prevent tipping or pitching motion of the pusher, as it is advanced toward the open end of the compartment. The pusher is preferably provided with a plurality of spikes 26 which can bite into the end of a block of cheese or other food product. The spikes prevent upward movement of the cheese along the face of the pusher as the cutter blade is advanced downwardly to slice the end of the block of cheese, as will be described.

Figure 10:
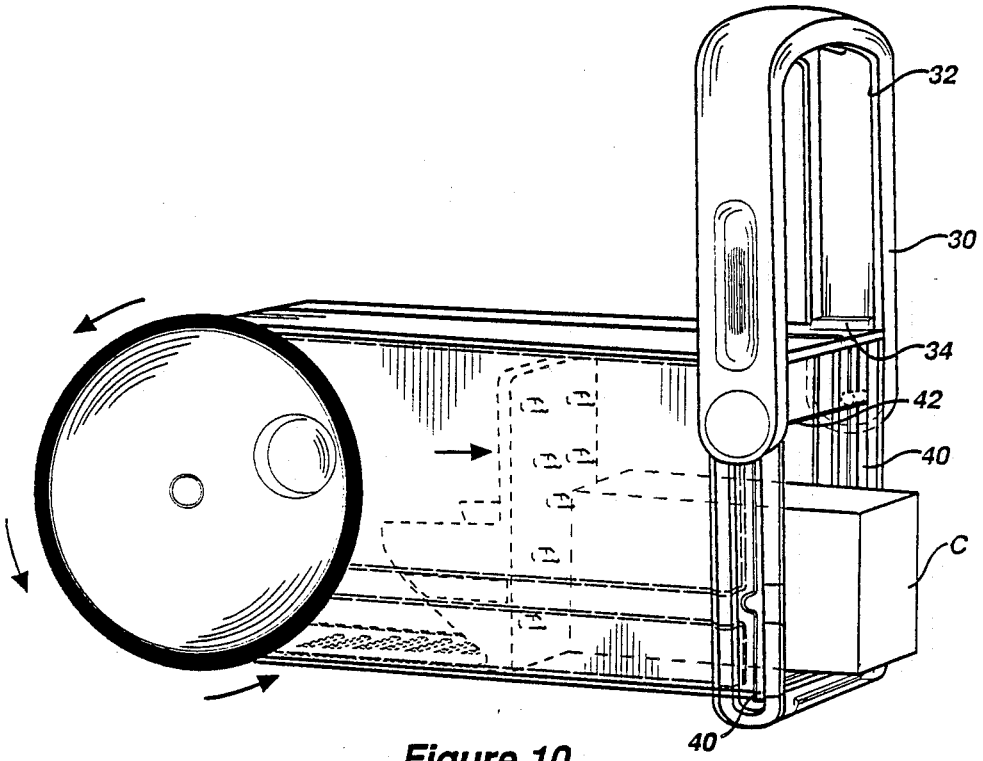
FIG. 10 is another operational isometric showing further advancement of the drive mechanism so that the cheese is now extending out and the end of the compartment is open to allow passage of the cheese.

A slicer mechanism 28 is provided on the open end of the compartment. The slicer mechanism includes an inverted U-shaped handle 30 (FIG. 10) having side flanges 32 that fit over enlarged bars 34 molded in the side walls of the compartment. Thus, the handle can move up and down, but it cannot tip or move fore and aft along the compartment. The side walls of the compartment are also provided with slots 40 within which passes a cutting wire 42. The cutting wire is secured to the opposite ends of the handle 30 in a taut condition. Thus, by moving the handle up and down, the wire 42 slices through the protruding block of cheese C, as shown in FIG. 10. The slots 40 are of a sufficient downward length that the wire passes all the way through and beyond the bottom of the block of cheese.

The open end of the compartment is uniquely hermetically sealed by a flexible cover 46 that rides in and is guided by opposed vertical grooves 48 in the inside of the side walls. The grooves 48 continue and join grooves 60 along the upper end of the side walls. The grooves continue and join lower grooves 61 at the rear and lower ends of the side walls.

The flexible cover 46 is elongated and is provided on its inside surface with a molded rack 64. This rack meshes with a pinion gear 66 (FIG. 4). The pinion gear is part of a gear reduction unit which meshes with a gear 68 that is fixed to an axle 69 of a disc 70. Rotation of the disc 70 causes the pinion gear to drive the rack and thus open or close the cover 46. When the cover is closed, it is hermetically sealing the interior of the compartment.

Figure 1:
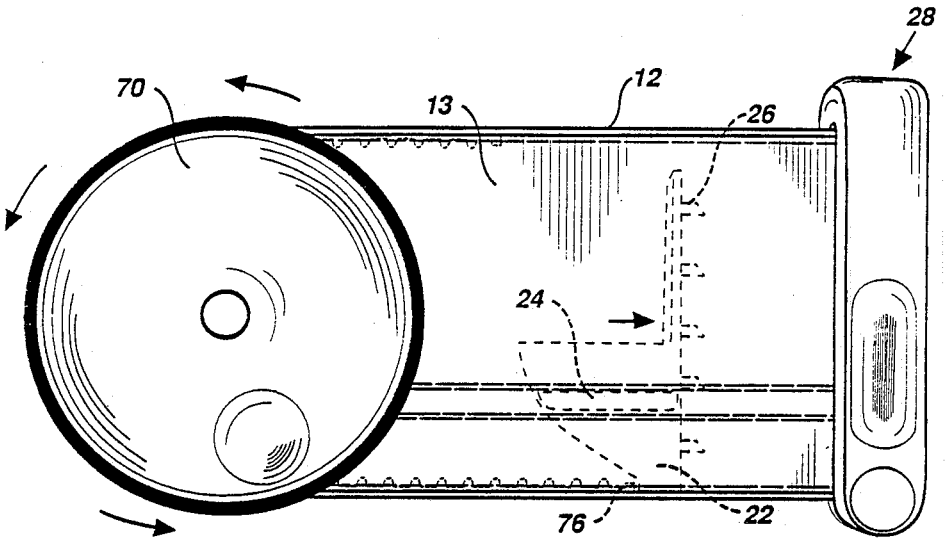
FIG. 1 is a right side elevation of the dispenser.
Figure 2:
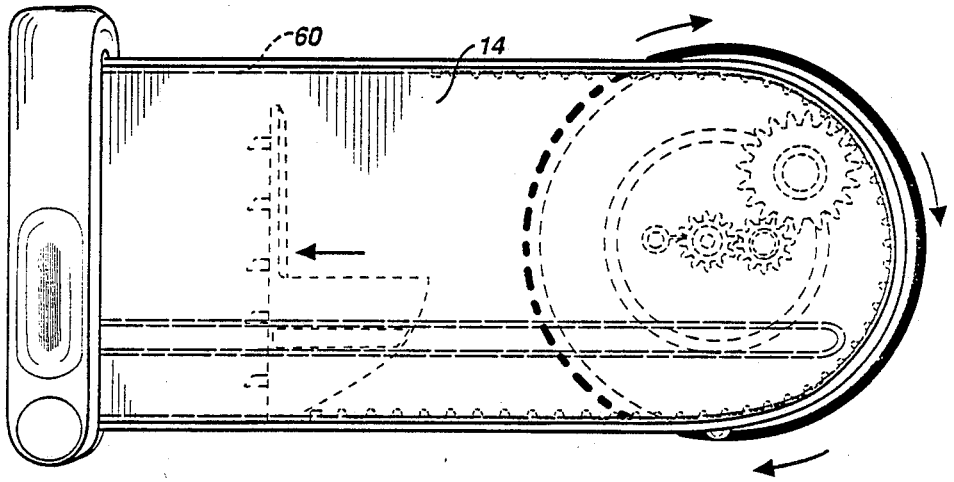
FIG. 2 is a left side elevation of the dispenser.
Figure 3:
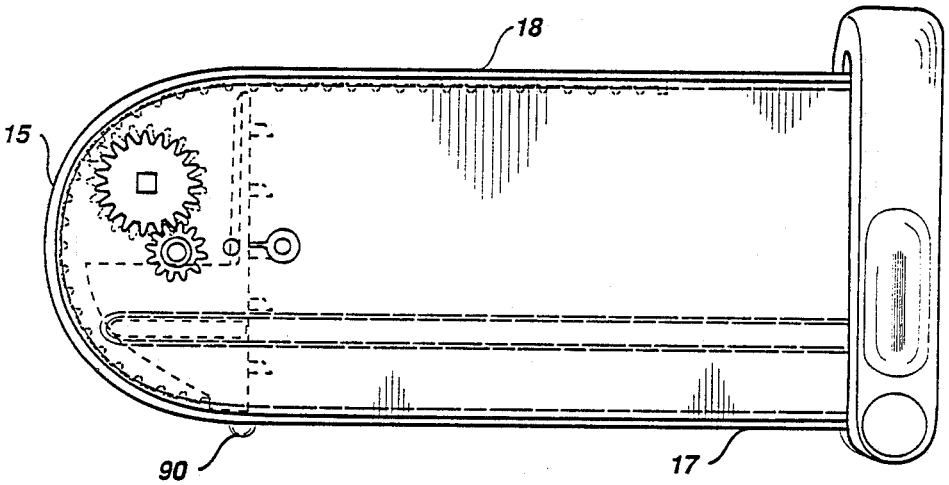
FIG. 3 is a view similar to FIG. 1 but with parts removed for clarity.
Figure 8:
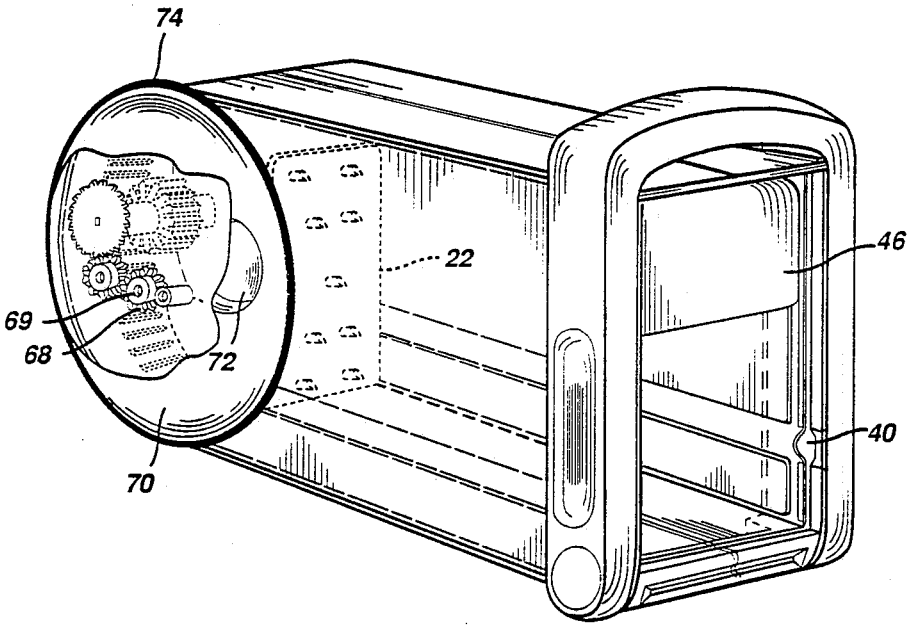
FIG. 8 is an isometric of the dispenser showing parts broken away for clarity.

As best shown in FIG. 8, the disc is provided with a finger detent 72 for manually rotating the disc. The disc is also uniquely provided with a friction or a rubber ring 74 on its periphery The disc extends below the bottom of the compartment. By pushing downwardly and forwardly, the disc is caused to rotate by its frictional surface engaging the surface upon which the compartment is resting, causing the door or cover 46 to open and to power the pusher 22 forwardly. The pusher is moved by being pushed by the lower end 76 of the door, as best shown in FIG. 1. By rotating the disc in the opposite direction, the lower end 76 of the flexible cover is removed from behind the pusher 22, allowing the cheese to be pushed back into the compartment manually. Meanwhile, the further rotation of the disc causes the cover to pass down over the front of the open end to seal the compartment.

A small protrusion or a foot 90 is provided to steady the bottom of the compartment when the compartment is pushed downwardly when using the peripheral frictional surface of the disc to advance the cheese.

Figure 9:
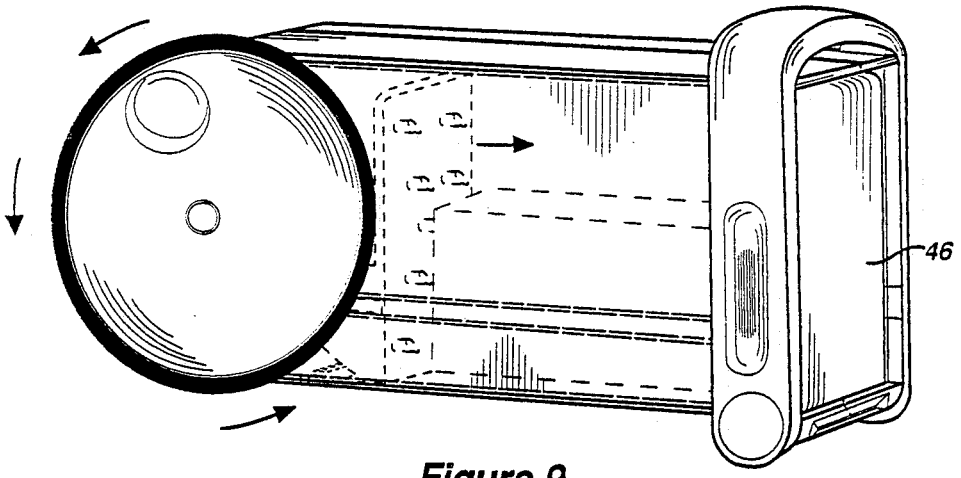
FIG. 9 is an operational view showing the dispenser closed with the drive mechanism beginning to advance the cheese.

Operation of the dispenser is best shown in FIGS. 9 and 10. The disc can be rotated manually or pushed along the countertop. Advancement of the disc in the direction of the arrows causes the pinion gear 66 to pull the flexible cover rearwardly and to advance the lower end of the flexible cover forwardly. The cover then opens, revealing the open end of the compartment. The pusher is advanced by the lower end of the flexible cover, advancing the cheese. A clicker tab 95 makes an audible sound as it rides over the teeth of a gear 94 when a desired amount of cheese (one slice) has been advanced. The clicker tab movement from tooth to tooth can also be felt by the user to determine when the desired thickness of the cheese has been dispensed. After the cheese is dispensed its desired thickness, the handle 30 is pushed down with the wire 42 slicing a piece of cheese from the end of the block of cheese.

The handle is then raised and the disc rotated to move the cheese another increment of distance and the steps repeated.

When sufficient cheese has been sliced, the compartment is then pushed back along the surface upon which it is resting or the disc is manually rotated. This will move the flexible cover forwardly until it travels down to begin closing the open end. At this time, the lower end of the flexible cover has been removed from engagement with the pusher so that the pusher and the block of cheese can be pushed manually back into the compartment. Further rotation of the disc will then completely close the cover sealing the compartment.

While the preferred embodiments of the invention have been illustrated and described, it should be understood that variations will be apparent to one skilled in the art without departing from the principles herein. Accordingly, the invention is not to be limited to the specific embodiments illustrated in the drawings.

I claim:

1. A solid food dispenser comprising a compartment formed by a closed top, bottom, rear end, and side walls, and a completely open front end, a flexible cover, guideways on the compartment for guiding the flexible cover from within the compartment over the open front end to close the front end and seal the inside of the compartment, a pusher for pushing said food from said compartment, one end of said cover abutting against said pusher, and means for simultaneously moving said flexible cover and said pusher, said moving means including a rack disposed on the inside of said cover, a large disc mounted entirely on the outside of the dispenser and a gear reduction unit coupled between said rack and said large disc, wherein rotation of said disc conveys said flexible cover to thereby simultaneously open said cover and advance said pusher towards the open end of said compartment, and wherein said gear reduction unit is disposed interior to a portion of said flexible cover adjacent said rear wall.

2. The dispenser of claim 1, said disc having a frictional member on the periphery thereof, said disc extending below the bottom of the compartment whereby pressing the compartment downwardly and forwardly causes the disc to rotate and move the door and the pusher.

3. The dispenser of claim 1, said pusher including forwardly protruding spikes for penetrating a piece of food and thereby resisting upward movement of the food relative to the pusher.

4. The dispenser of claim 1, further including a slicing mechanism having a cutter mounted to pass along the open front end of the compartment.

5. The dispenser of claim 1, further including a slicing mechanism having a blade mounted to pass along the open front end of the compartment.

6. The dispenser of claim 1, including a clicker mechanism to signal when a desired amount of cheese has advanced so as to provide a desired thickness of cut cheese slice.

7. The food dispenser of claim 1, further comprising means for guiding said one end of said cover along an unobstructed path such that said door and said pusher can be removed from said compartment.

8. A solid food dispenser, comprising:

a compartment formed by a closed top, bottom, rear end, and side walls, and a completely open front end;

a flexible cover;

a pusher for pushing said food from said compartment;

guideways disposed within said compartment for guiding said flexible cover and said pusher such that said cover can close said open front end to seal the inside of said compartment, said guideways including a lower set of guideways extending lengthwise of the compartment and having open ends at the front end of the compartment for moving the cover outwardly along an unobstructed path such that said cover and said pusher can be removed from said compartment; and means for simultaneously moving said cover and said pusher.

9. The food dispenser of claim 8, wherein said moving means comprises:

a rack disposed on the inside of said cover;

a large disc mounted on the outside of said compartment; and a gear reduction coupled between said rack and said large disc such that rotation of said disc conveys said flexible cover to thereby simultaneously open said cover and advance said pusher towards the open end of said compartment.

10. A solid food dispenser, comprising:

a compartment formed by a closed top, bottom, rear end, and side walls, and a completely open front end;

a flexible cover;

a pusher for pushing said food from said compartment;

guideways disposed within said compartment for guiding said flexible cover and said pusher such that said cover can close said open front end to seal the inside of said compartment; and means for simultaneously moving said cover and said pusher, said moving means including a rack disposed on the inside of said cover, a disc mounted entirely on the outside of said dispenser and a gear reduction unit coupled between said rack and said disc such that rotation of said disc conveys said flexible cover to thereby simultaneously open said cover and advance said pusher towards the open end of said compartment, said gear reduction being disposed at said closed end of said compartment so as to provide the maximum degree of travel of said pusher; and wherein said gear reduction unit is disposed interior to a portion of said flexible cover adjacent said rear wall.

11. The food dispenser of claim 10, wherein said disc has a diameter sufficiently large such that a circumferential portion of said disc extends below at least one of said side walls to permit a user to roll said disc along a surface so as to convey said pusher and said cover.

* * * * *